US005118043A

United States Patent [19]

Marklund et al.

[11] Patent Number: 5,118,043

[45] Date of Patent: Jun. 2, 1992

[54] METHOD AND APPARATUS FOR AUTOGENOUS COMMINUTION PRIMARILY OF OVERCOMPETENT, HETEROGENEOUS MINERAL MATERIAL

[75] Inventors: Olle Marklund; Gunnar Södermark, both of Skellefteå , Sweden

[73] Assignee: Olmar AB, Skellefteå , Sweden

[21] Appl. No.: 576,530

[22] PCT Filed: Apr. 5, 1989

[86] PCT No.: PCT/SE89/00177

§ 371 Date: Oct. 5, 1990

§ 102(e) Date: Oct. 5, 1990

[87] PCT Pub. No.: WO89/09652

PCT Pub. Date: Oct. 19, 1989

[30] Foreign Application Priority Data

Apr. 5, 1988 [SE] Sweden ..... 8801238
Apr. 5, 1988 [SE] Sweden ..... 8801239

[51] Int. Cl.[5] ..... B02C 17/00

[52] U.S. Cl. ..... 241/24; 241/29; 241/79.3; 241/80; 241/81

[58] Field of Search ..... 241/79.3, 80, 171, 81, 241/24, 21, 29

[56] References Cited

U.S. PATENT DOCUMENTS 1,058,953 4/1913 Easton ..... 241/79.3 X
3,078,050 2/1963 Hardinge ..... 241/24
3,231,203 1/1966 Hardinge et al. ..... 241/24
3,773,268 11/1973 Bond ..... 24/284 X
3,924,814 12/1975 Fahlstrom et al. ..... 241/80
4,441,659 4/1984 Marklund ..... 241/79.3 X
4,681,268 7/1987 Marklund et al. ..... 241/24
4,726,531 2/1988 Strasser ..... 241/171

*Primary Examiner*—Mark Rosenbaum
*Assistant Examiner*—Frances Chin
*Attorney, Agent, or Firm*—Fleit, Jacobson, Cohn, Price, Holman & Stern

[57] ABSTRACT

In autogenous grinding of mineral material in a grinding mill with a screening wall a method is provided for enabling the removal of at least three different fractions without the need of the screening wall being divided into sectors, thus increasing grinding material turnover and grinding capacity, by passing through openings (8) distributed over the screening wall (7) a mixed material fraction containing all material fractions having a maximum particle size less than or equal to the largest size opening for screening coarse material in the size intended for use as a grinding charge in a further mill (23) and dividing up the mixed material fraction into at least three fractions in a classifying apparatus (13), by always taking out from the classifying apparatus (13) at least a fine fraction, a coarse fraction and a medium coarse fraction, the latter two fractions being kept separate for permitting, as required, diversion (38) of the coarse material fraction as grinding charge to following grinding steps, the two fractions being put together when the need of charge material is not present, when they may undergo reduction to sub-critical sizes for subsequent return to the mill (1) for renewed grinding.

13 Claims, 4 Drawing Sheets

METHOD AND APPARATUS FOR AUTOGENOUS COMMINUTION PRIMARILY OF OVERCOMPETENT, HETEROGENEOUS MINERAL MATERIAL

BACKGROUND OF THE INVENTION

The present invention relates to an apparatus for autogenous grinding of a homogeneous or heterogeneous coarse crushed mineral material in a rotary drum mill with a screening wall arranged inside the drum at its discharge end. In autogenous grinding, the grinding charge active for grinding in the mill or mills comes from the mineral material itself, a subsequent grinding step being supplied with a grinding charge from the grinding charge of a preceding mill by selective discharge from the latter.

The present invention also relates to a method of comminuting a heterogeneous, coarse lump or coarsely crushed mineral material. In the expression "mineral material" there may also be included "industrial minerals" and together or individually these kinds of materials are also called "ore" or "ores" in the following description.

In dressing mineral material, e.g ore, for the selective or collective extraction of valuable substances or material components, these operations or processes are preceded by a mechanical pulverization of the material such that the valuable components are separated from each other. By using known separation processes the valuable components can be segregated. The mechanical pulverization or comminution usually starts already al the extraction of ore from a mine or surface digging. It is also normal here to crush the ore in one or more steps before final grinding to a fine material size suitable for the process. Depending on the properties of the ore , as well as the grinding technique which is to be used, the mineral material is crushed to a maximum lump size varying between about 500–100 mm.

The techniques dominating in grinding operations are:

autogenous, in which grinding is done by utilizing grinding bodies from the material itself;

semi-autogenous, in which the grinding bodies form the material itself are partially substituted by steel balls;

conventional, in which grinding is done exclusively by steel rod or ball grinding bodies.

Historically, the conventional grinding technique has been predominant, and it is preceded by extensive crushing of the mineral material or ore before grinding, which gives a stable grinding process, due to the grinding charge being homogeneous in weight and composition. However, the conventional technique is the most outstandingly expensive of the grinding techniques mentioned, because of high investment and operational costs.

Particularly with lean ores and high production, the autogenous technique is to be preferred to the others, due to lower costs and the absence of foreign material in the shape of grinding bodies, and also because the conventional technique gives rise to Fe ions in the comminution, which sometimes results in a poorer yield in flotation subsequent to grinding.

By autogenous techniques is intended the situation where the grinding charge essentially comprises grinding bodies from the mineral material itself, but that both external competent mineral material and steel balls or other material can be added as substitutes when there is a lack of supply of grinding bodies from the material itself.

A very usual situation is, however, that the mineral material contains too great an amount of difficultly ground, so-called "over-competent" material. which has a very negative effect on grinding capacity, and thereby on both grinding result and cost, and this situation must be dealt with if required profitability is to be attained with autogenous grinding.

It is known from the state of the art, e g. Swedish patent document SE-PS 7909921-4, that in grinding mineral material there is always material having different properies to be taken into consideration, and the known technique giving the best technical/economical result is selected, with due regard to the material properties.

Within the field in question, it is known that, depending on its comminution properties and /or its "grinding resistance", the mineral material has different properties, which form the autogenous grinding aspect can normally be divided into three different competence ranges, or be defined as:

1). Competent, i.e ores having sufficient mechanical strength to form an active grinding charge by themselves, and are thus suitable for autogenous grinding;

2). incompetent, i.e. ores requiring an addition of foreign bodies, e.g. steel balls, to enable their comminution, and which are thus suitable for semi-autogenous grinding or conventional grinding; and 3). over-competent, i.e. ores which have very high mechanical strength, where their comminution in an autogenous grinding process requires a very high energy input, and which are thus suitable for conventional or semi-autogenous grinding.

Within this technological field it is further known that comminution of a mineral material with the aid of autogenous grinding techniques lakes place, generally speaking, in three different ways, namely:

1). By impact, i.e. shock on falling onto a substructure, or against the material itself, which is saving in energy;

2). by attrition, which is the most usual way in crushing, in rod or ball mills or in autogenous mills under favorable conditions, and means that small pieces are comminuted by pressure and shearing between larger pieces and/or between surfaces under pressure, this way resulting in a high saving in energy and being striven after in autogenous grinding processes;

3). by abrasion, i.e. comminution by the surfaces of material pieces being rubbed/worn against each other, which normally requires a large amount of energy and often gives an unsuitable, uncontrollable ground product, and should therefore be avoided as far as possible.

With "over-competent" material there is formed an excess of so-called critical material, i.e. difficultly ground fractions. This and increasing over-competence result in that the grinding space of the mill is successively filled by critical f actions, with resulting rapidly decreasing grinding capacity.

In the above mentioned Swedish patent examples are given of a technique that also substantially improved autogenous grinding of material having a pronounced over-competence for certain intermediately competent materials and especially such that are clearly heterogeneous, this known technique gives unnecessarily high plant and operating costs, since in such cases more force than necessary is used.

BRIEF SUMMARY Of THE INVENTION

One object of the present invention, is to provide autogenous grinding, preferably wet grinding of a mineral material suitable for the process, to enable the discharge from a primary mill of a primary, ready-ground product, and also an over-critical fraction for being comminuted in an intermediate apparatus in the circuit to sub-critical partical size for returning this fraction, as well as enabling selectively and to a controllable amount the separation of a fraction from the critical fraction to form a grinding charge for a following grinding step, e.g. in a secondary pebble grinding step after a primary grinding step.

A further object of the invention is to achieve a method of comminuting a mineral material that gives the best possible solution to the problem of lowest investment and operating costs, as well as improving the economy of otherwise possible autogenous circuits, simultaneously as it eliminates the need of semi-autogenous grinding.

These inventive objects are achieved by the present apparatus and method being given the characterizing features disclosed in the claims. With the apparatus and method of the invention there is provided the possibility of mastering with an extremely simple apparatus the problems occurring in autogeous grinding of over-competent material. At the same time as the primary grinding step is steered towards a technically/economically favorable position, there is also obtained a controllable discharge of secondary grinding bodies as a grinding charge for a subsequent secondary grinding step.

Certain mineral material may contain barren rock, and particularly such as hat contained in what is defined here as critical fractions. The apparatus is also suitable here for taking out given fractions for which processing can continue via a special apparatus for separating barren rock.

With regard to the method in accordance with the present invention of comminuting heterogeneous mineral material in an autogenous, primary grinding system, it is more specifically one where before the coarsely crushed mineral material is supplied to the autogenous grinding circuit it is divided up into a coarse and a fine fraction, the coarse fraction being such that it is suitable as grinding bodies in the grinding charge, while the fine fraction is subjected to crushing in one step to a size which from a technical aspect gives a heavy reduction of fractions critical to the grinding, whereupon the fine fraction crushed in one step is put together with the coarse fraction forming the charge and is fed into an autogenous, primary mill in an intended mixing ratio.

In the now started autogenous grinding, the material of non-critical character, i.e. the easily ground large and smaller lumps, will be quickly reduced, while critical fractions remaining from the precrushed fraction as well as those newly formed by reduction of the large fraction arc taken out selectively from a classifying apparatus connected to the mill, after which the fraction taken out from the classifying apparatus is subjected to special fine crushing to sub-critical size and then returned to the primary mill.

There is achieved by this inventive method the advantage that minimum effort is required, simultaneously as controlled regulation of the critical fractions is obtained. Grinding efficiency is thus increased considerably, and semi-autogenous grinding with steel grinding bodies is no longer required to any extent.

In accordance with the present method, coarsely crushed mineral material is first crushed into two fractions, the coarse fraction thus obtained then being fed, preferably via an intermediate store, as a grinding charge to an autogenous mill, while the other fine fraction obtained at the division into two fractions is taken to a crusher for reduction of the substantial share of fractions critical for grinding that it contains, the resulting crushed product then being fed, preferably via an intermediate store, to the autogenous mill as the essentially largest grinding charge share therein.

Remaining and newly formed critical fractions are taken from the autogenous mill via the special, inventive classifying apparatus connected to it, and these fractions are then further reduced in a crusher for return to the autogenous mill.

Accordingly, with the method of this invention, most ores ground today using the semi-autogenous technique because they are over-competent can be ground using the inventive, fractional method, which gives a considerably high degree of grinding efficiency, no costs for steel or other foreign, heavy grinding bodies and in addition a grinding product that is well adjusted to subsequent processes What are designated herein as "critical" or "critical sizes" are such materials that due to their strength do not allow their comminution by attrition.

BRIEF DESCRIPTION OF THE DRAWINGS

The invention will now be described in more detail in the following with reference to the accompanying drawings, wherein.

DETAILED DESCRIPTION

Figure 1:
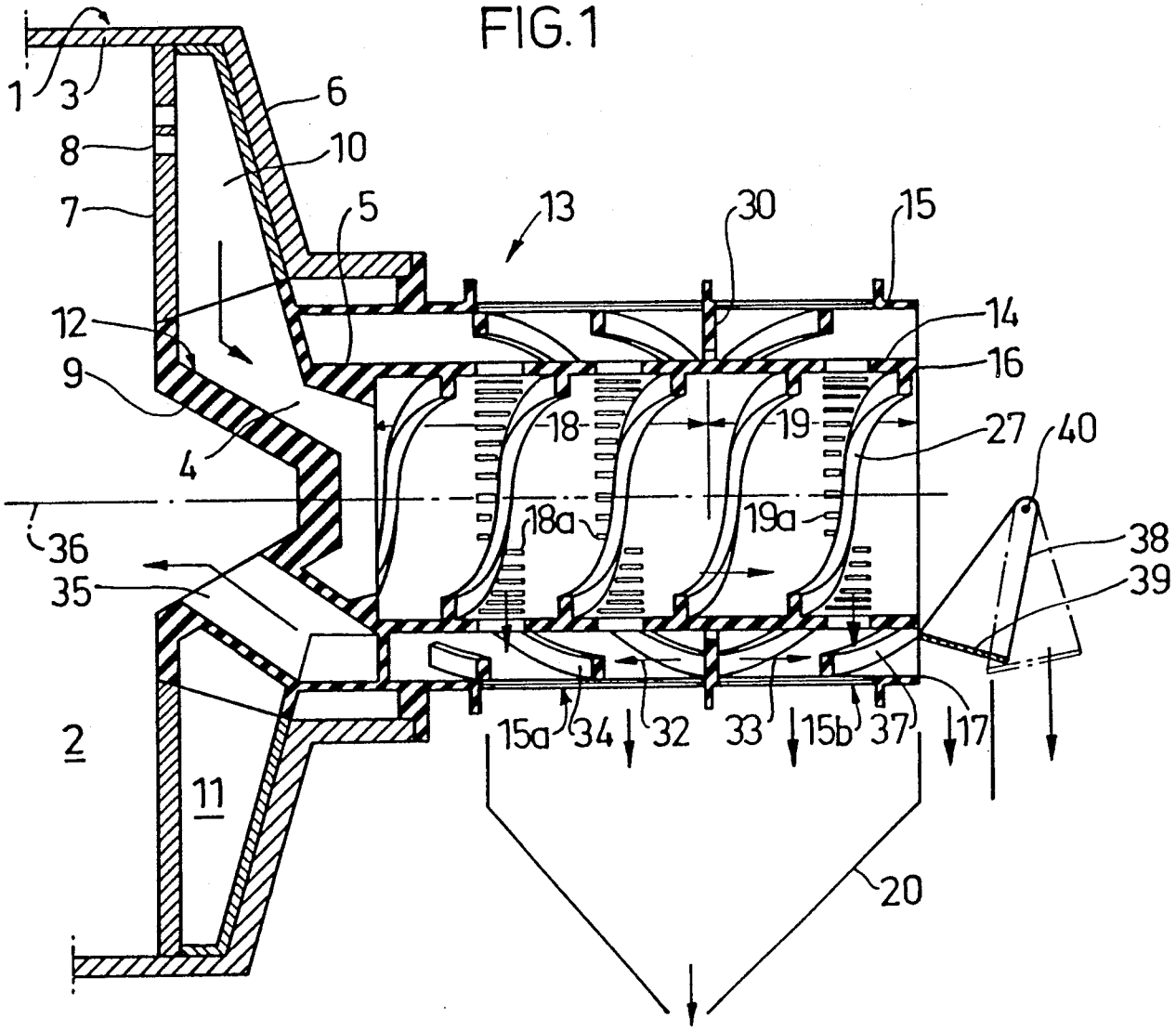
FIG. 1 is an axial cross-sectional view through an apparatus in accordance with the present invention in its basic embodiment.

In the drawings, a drum mill intended for autogenous wet grinding is denoted by the numeral 1, and may be, although not necessarily so, the primary mill in a grinding plant containing several autogenous grinding steps. The mill 1 includes a drum 3 enclosing a grinding space 2, the drum rotating about its substantially horizontal, longitudinal axis. The grinding drum 3 is conventionally equipped with a lining and lifters of wear-resistant material, e.g. rubber, although this is not shown on the drawings.

Figure 2:
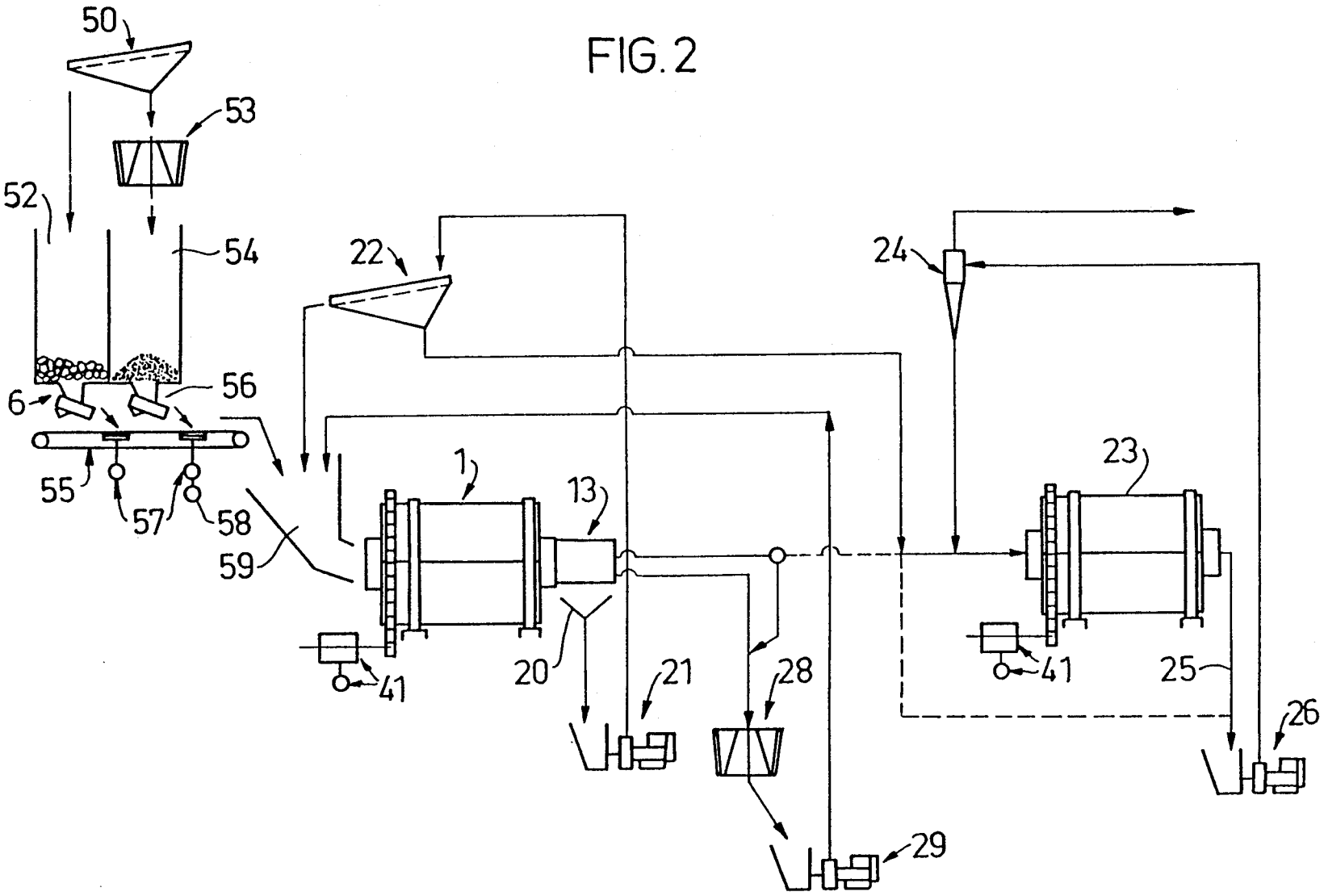
FIG. 2 is a flow diagram illustrating the inventive method applied to a 2-step autogenous grinding plant, in which the inventive apparatus is included as an essential part.

A screening wall 7 is disposed inside the drum 3, and spaced from its end wall 6, which is provided with a discharge opening 4 and a hollow trunnion 5. The screening wall 7 is provided over its entire surface with slots 8 of preferably rectangular configuration, with a greatest transverse dimension permitting the discharge from the grinding space 2 of mixed material having a maximum particle or lump size normally corresponding to the upper or largest lump size for coarse material in the over-critical size class, and which is intended for use as a grinding charge or grinding bodies in a following autogenous secondary mill 23 (FIG. 2). The mixed material discharged from the grinding space 2 via the screening wall slots 8 thus contains fractions of fine (primary ready-ground), intermediate and coarse material. The slots 8 are also arranged regarding size, number and position such that during normal operation the mill 1 is always caused to maintain the desired pulp level and charge composition in the grinding chamber 2.

The screening wall 7 tightly surrounds a boss 9, which suitably has the shape of a truncated cone, with its base in tho plane of the screening wall and the rest of il projecting into the discharge opening 4 and trunnion 5. The boss 9 is concentric with the drum 3. As with the screening wall 7, the end wall 6 of the drum is provided on its side facing the grinding space 2 with radial and/or substantially radial lifters 10 of wear-resistant material, e.q. rubber. The end wall lifters 10 work in a cavity 11 defined by the end 6 and screening wall 7, this cavity receiving the mixed material discharged via the slots 8, and which is lifted up by the lifters 10 and conveyed towards the center of the end wall. The outer side of the boss 9 functions as a deflector 12 for this material and directs it towards the discharge opening 4 and trunnion 5 and to a classifying apparatus 13 coaxially connected to the discharge end of the drum and rotating with it.

The apparatus 13 includes a coarse screening barrel 14 with a fine screening barrel ? 5 coaxially surrounding it, the latter being tightly connected to the end wall 6 of the drum and extending coaxially past the discharge end 16 of the coarse screening barrel 14 with its discharge end 17, or flush with the discharge end 16 or inwards of it. Suitably, the barrel 14 may have the same diameter as the discharge opening 4 and constitute a direct continuation of the end wall discharge trunnion 5, or be tightly connected to it.

With this classifying apparatus 13, in accordance with the invention, there is obtained a very advantageous process function which may be summarily described as follows. The material/watery mixture discharged through the slots 8 is subjected to classifying and pulp separation in the apparatus 13, the mixed product fed into it being classified into a maximum of four kinds of poducts, namely: 1) a primary ground product comprising the finest material fraction including substantially all the water, which goes to an outside classifying means 22 of the grinding circuit (see FIG. 2 ; 2) a fraction above this product and having a particle size less than the one critical for grinding; 3) a fraction containing critical grinding sizes up to the least grinding Pebble size for a grinding charge required in a secondary pebble grinding step subsequent to the primary step; 4) a grinding pebble fraction which, according to this invention, may be mixed with the preceding critical fraction and be separately treated in a way described more closely hereinafter; and also may be controllably directed to a secondary mill 23 as a grinding charge when so required.

Simultaneously as the apparatus 13 is a classifying means it is also implemented as a conveying means for conveying the respective fractions to subsequent treatment steps. The primary screening barrel 14 of the apparatus 13 is divided into a first zone 18 with screen openings 18*a*, allowing material of sub-critical size to pass to the surrounding fine screening barrel 15 with its screen openings 15*a*, 15*b*, ann also to a second zone 19 with screen openings 19*a* having a size suited to the classifying lower limit for grinding Pebbles in the grinding charge of the secondary step. All solid material, as well as substantially all the water, which passes through the screen openings 15*a*, 15*h*, these having a least width in the order of magnitude 5–15 mm, is collected in a funnel 20 for pumping by a pump 21 or being conveyed in some other way to the outside classifying means 22 of the plant. From the means 22 the upper fraction returns to the mill 1 and the lower fraction to the secondary grinding step 23. Alternatively, this fraction is taken past the step 23 to a cyclone 24 after the step 23, via an outlet line 25 from the step 23 to a pump 26.

The coarse screen barrel 14 is internally provided with conveying means in the shape of helically extending baffles or guides 27, for conveying outwards material coming from the opening 4, and thus they aid in the discharge from the coarse sceen barrel 14 the fraction comprising pebble sized material. In given amounts, this material is taken with the aid of a diverting means 38 to the secondary mill 23 for forming its grinding charge, the remaining part or excess of this fraction being put together, by putting the diverting means 38 into the position illustrated in FIG. 1, with the critical grinding fraction that has passed through the screen openings 19*a*. These two fractions are then subjected to (preferably wet mechanical) comminution to sub-critical size, e.g. in a crusher 28, for return to the mill 1 with the aid of a pump 29 or other suitable conveying means.

For separating the material allowed to pass through the screen openings 19*a* from the material passing through the screen openings 18*a* in the coarse screen barrel 14, the fine screen barrel 15 is provided with a partition wall 30 at the interface between zones 18 and 19. This divides the fine screen barrel 15 into two separate zones 32 and 33), such that the zone 32 contains the openings 15*a* and zone 33 the screen openings 15*b* for the primary, ready-ground fraction. The barrel 15 is interiorly provided in the zone 32 with conveying means in the shape of helically extending guides or baffles 34. The material passed through the openings 18*a* which is not allowed to pass through the openings 15*a* is returned, with the aid of the baffles 34 to the grinding space 2 via at least one walled duct 35 connecting zone 32 of the fine screen barrel to the grinding space 2. There is thus returned to the grinding space via this duct the material conveyed by the baffles 34 during the part of each revolution the drum makes when the duct 35 is above a horizontal plane through the longitudinal axis 36 of the drum 3.

Zone 33 of the fine screen barrel 15 is provided, to enable obtaining positive discharge of the critical fraction which is allowed to pass through the openings 19*a* in the coarse screen barrel 14 and also the grinding pebble fraction, where applicable, with helically extending baffles 37 adapted to convey in the opposite direction to the baffles 34 in zone 32. The material discharged from the classifying apparatus 13 with the aid of these baffles 37 is diverted, as previously mentioned, to a means, e.g. for wet mechanical comminution, for reducing this fraction to sub-critical size.

As previously mentioned, there is a diverting means 38 arranged :n connection with the discharge end 16 of the coarse screen barrel 14. This means is provided with a chute 39 and is pivotally mounted at 40 to a stationary holder (unillustrated for movement between a first and a second position. The first position is shown dashed in FIGS. 1,3 and 4, in which the means 38 with its chute 39 is spaced from the end of the barrel 14, thus allowing the material passed out of one barrel to fall into the fine screen barrel 15 and be discharged with the aid of its baffles 37 from the classifying apparatus 13, in the oases where the fine screen barrel 15 extends past the discharge end 16 of the coarse screen barrel, or the material discharged from the coarse screen barrel 14 and the material discharged from the fine screen barrel 15 are together taken further to the means 28 for further reduction in the oases where the fine screen barrel has its discharge end 17 in line with or inwards of the discharge end of the coarse screen barrel. The second position is the one illustrated in solid lines in FIG. 1, where the diverting means with its chute 39 lakes off the fraction conveyed out by the baffles 27 from the inside of the barrel, this fraction being the grinding pebble fraction, to the following secondary grinding step 23, simultaneously as the material discharged from the fine screen barrel is taken to the means 28 for further reduction.

The removal of grinding bodies from the classifying apparatus 13 to the secondary mill 23 is preferably controlled in response to the momentary need of this mill with the aid of power or weight sensing control means 41, such that when the mill requires grinding bodies the means 41 causes the diverting means 38,39 to assume the position illustrated in FIG. 1, and when this need is no longer present, the means 41 causes, preferably in coaction with a like control means 41 for the primary mill 1, that the diverting means 38,39 is pivoted away from the position illustrated in FIG. 1, and thus from the discharge end 16 of the coarse screen drum 14 included in the classifying apparatus 13. In this position the grinding pebble fraction is mixed with the critical fraction from zone 33 of the fine screen barrel 15, the two fractions then being taken to the means 28 for further reduction and return to the initial mill, i.e. the grinding mill 1 in the present case.

With this arrangement in accordance with the invention there is achieved the possibility, which is very advantageous from the profitability appeal, of taking out from an autogenous grinding charge the maximum amount of critical fractions together with primary, ready-ground material, as well as sub-dividing and controlling this discharge such that a subsequent secondary and/or tertiary grinding step is always supplied with the required or demanded amount of grinding bodies. Al the same time, the problem in the known technology of an increasing excess of critical material in the primary mill is entirely eliminated. One of the distinguishing features enabling this is the screening wall 7 disposed in the grinding drum 3. This wall has an area available for making orifices which is equal to its total superficial extent less the minor area taken up by the boss 9, which is provided for returning material from the classifying apparatus 13 via the duct 35 to he grinding space 2.

Figure 3:
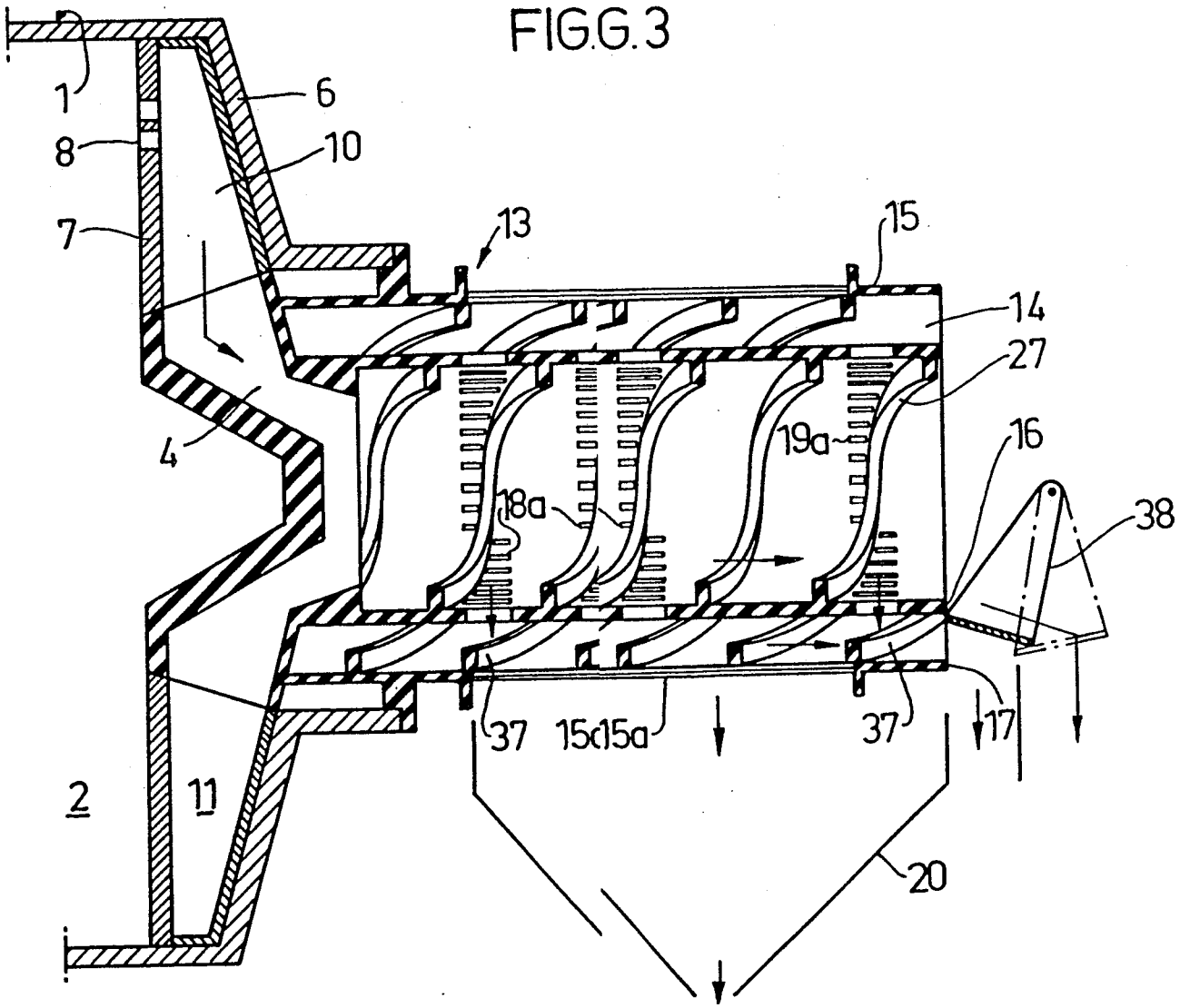
FIG. 3 is an axial cross-sectional view through a modified embodiment cf the apparatus of FIG. 1.

In FIG. 3 there is illustrated an embodiment of the present invention which is particularly suitable for over-competent, homogeneous material, i.e. such material that after grinding in the primary mill does not contain any great amount of the kind of product under 2) on page 2 of this description, this product having a greatest particle size which is less than the size critical to grinding.

This embodiment differs from the one in FIG. 1 in that the fine screen barrel 15 is not divided into zones, but is provided along its whole length with the same baffles 37 as in the zone 3 of the embodiment in FIG. 1. These baffles 37 convey to discharge al the material coming through the screen openings 18*a* and 19*a* in coarse screen barrel 14 that have a particle size greater than the greatest particle size of the finest material fraction. After discharge from the classifying apparatus 13 this material is taken to the subsequent reduction step 28. In the same way as with the embodiment in FIG. 1, the fine material fraction or primary, ready-ground material together with water passes out into the funnel 20 via the screen openings 15*a* of the fine screen barrel 15.

Since no material in this embodiment is intended to, or needs to be returned directly rom the fine screen barrel 15 to the grinding space 2, the return duct 35 has been omitted in FIG. 3. In addition, in the embodiment according to this figure the openings 18*a* in the coarse screen barrel 14 may have the same size as the openings 19*a*, if so desired.

The number of classifying steps in the embodiment of figure is thus 3, as compared with the four steps in the embodiment of FIG. 1, but for the remainder the embodiments are in mutual agreement.

Figure 4:
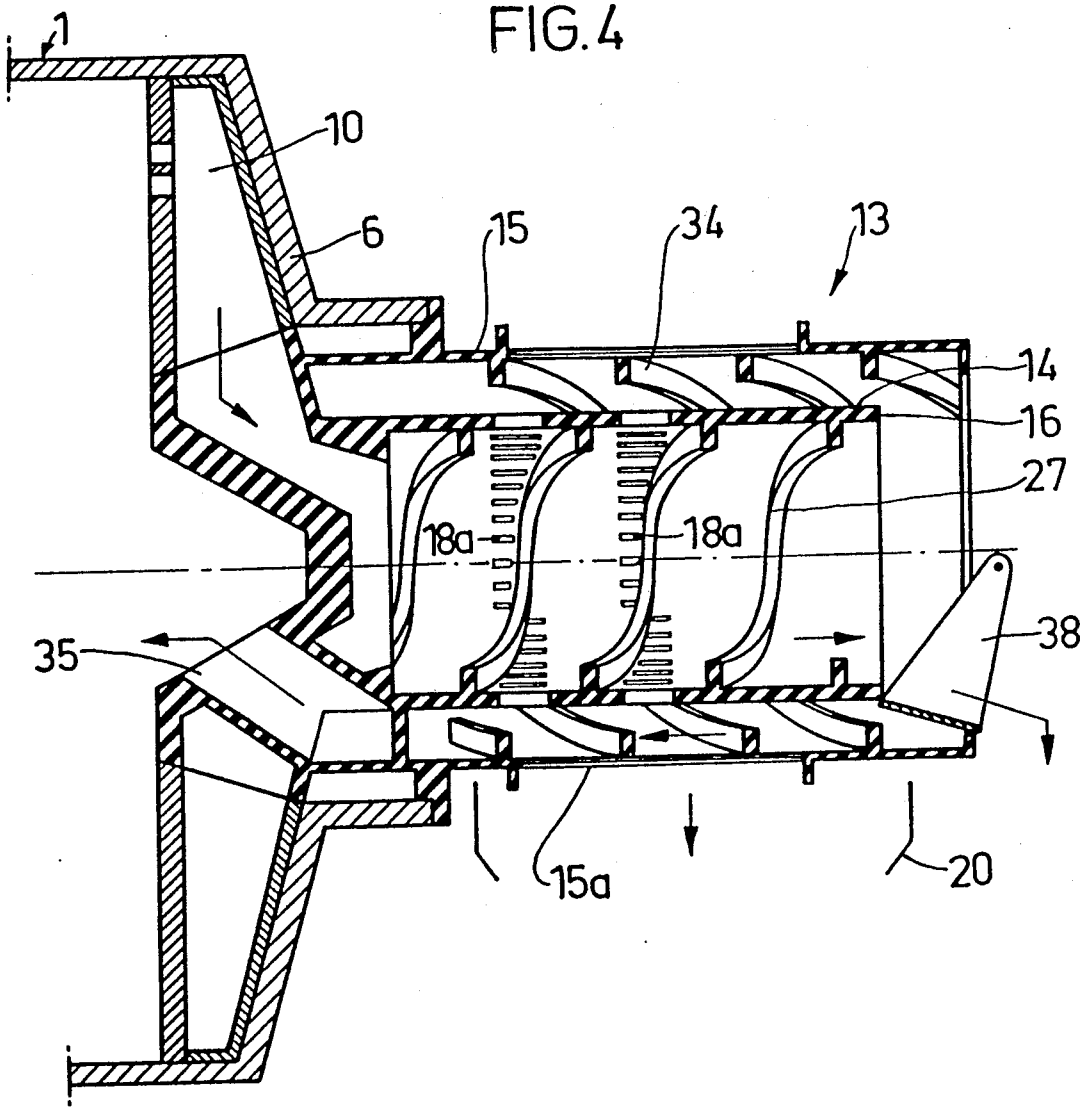
FIG. 4 is an axial cross-sectional view through further embodiment which is particularly suitable for material the major part of which is over-competent.

In autogenous grinding of certain materials, particularly those having high surface wear as well as favorable disintegration, i.e. competent materials, the above-described apparatus and process may not need to be utilized to its full extent, since the material supplied to the primary mill is rapidly ground to the desired particle size without particularly high energy consumption and without specially critical fractions being formed in the grinding charge. In this case also, the number of classifying steps may be reduced to three, as compared with the four steps in the embodiment of FIG. 1. This permits a simpler embodiment, which is illustrated in FIG. 4, this embodiment differing from the one in FIG. 1 by the fine screen barrel 15 extending past the discharge end 16 of the coarse screen barrel 14, and not being divided into any special zones. The barrel 15 is also equipped along its whole length with the same baffles 34 as those of the zone 32 in the embodiment of FIG. 1. With the diverting means 38 pivoted out to the position indicated by dashed lines, the baffles 34 of the fine screen barrel 15 convey all the material coming from the coarse screen barrel 14 to the return duct 35 for return to the grinding space 2, excepting the primary, ready-ground material, which passes out through the screen openings 15*a* and 15*b* in a manner previously described.

Since the material that this embodiment is specially intended for does not form any critical fractions needing separation from other fractions, the openings 18*a* and 19*a* of the coarse screen barrel 14 may be the same as in the embodiment in FIG. 1, but it is also possible to omit the openings 19*a* and instead allow the openings 18*a* to have a size corresponding to the size of the openings 19*a* in FIG. 1, i.e. the lower limit of the grinding pebble fraction, which is thus in this embodiment returned to the mill grinding space 2 in the oases where the following mill 23 requires an addition of grinding pebbles for its grinding function.

In this embodiment, taking out grinding pebble fractions from the grinding space 2 is only brought about by the need of grinding pebbles in the following grinding step, and not from any part of the grinding process in the primary mill grinding space 2, and thus the number of screen openings 8 in the screening wall 7 permitting the passage of the pebble fraction can be substantially reduced in comparison with the embodiments of FIGS. 1 and 3.

As already mentioned, most ores which are ground using autogenous grinding techniques include more or less homogeneous material, which can be more precisely expressed by saying that even in an apparently homogeneous material there are large differences in competence, disintegration properties etc. It is therefore very advantageous, not in the least from the economical aspect, that autogenous comminution of an ore material can take place such that the weaknesses of the material can be utilized in the first place. This is attained or enabled with the apparatus and method of the present invention, where the method itself may be described as a classifying technique where the crude ore is treated in the following manner.

As will be seen from the flow diagram of figure 2, incoming crude ore which has already been conventionally crushed to a lump size of 200–500 mm is fed to a screen 50, which divides the ore into two fractions in the tolerance range of ±100 mm. The coarser fraction is taken directly to a stockpile 52 and is used to form grinding charges for the primary grinding mill in a single or multi-step autogenous grinding plant. The fine fraction obtained from the screen 50 is taken to a crusher 53 and crushed in it in a first reduction to a lump size suitable for the material in question, thus also achieving that a large part of the critical sizes in it are removed. This crushed product is then taken from the crusher 53 to a stockpile 54, or optionally taken by a conveyor 55 to the autogenous primary mill 1.

In connection with each stockpile or hopper 52,54 there are preferably arranged weighing discharge means 56 for discharging the coarse fraction from the hopper 52, or the fine fraction from the screen 50 which is reduced in the crusher 5), onto the feed conveyor 55. This conveyor may also be equipped with weighing units 57 arranged directly after the respective discharge means 56. Preferably, there is also control equipment for controlling the total flow to the conveyor. The latter thus feeds the coarse fraction and the fine fraction which has been further reduced in the crusher 53 to the autogenous primary mill 1 via its feed hopper 59 in a predetermined ratio, the necessary amount of water also being supplied to the mill 1.

During the immediate residence time in the mill 1 there is a selective grinding of sub-critically sized material, as well as coarser material with weakness zones and of material having low competence. The material lumps of critical size accumulating in the grinding charge in the mill 1 now comprise still over-competent material from the size-reduced fine fraction from the crusher 53 and impact-disintegrated coarser charge material from the coarse fraction coming from the screen 50. There is thus obtained in the mill 1 an intermediate fraction containing malarial of critical size and material of over-critical size, i.e. charge material, which can form critical sizes by being further reduced, and in accordance with the invention is continuously taken out of the mill with the aid of a classifying apparatus, and is taken to the crushing step 28 in closed circuit with the primary mill 1 for further reduction and return via a pump means 29 to the feed hopper 59 of the mill for refeeding to the mill. Due to the material-selective first reduction in the mill 1, the required crushing of the fine fraction from the screen 50 in the crusher 53 is minimized, and the quantity of critical sizes is kept at a low level in the mill with the aid of continuous removal by the apparatus according to FIG. 1 or 4.

To obtain a favorable grinding sequence, coarse crushing should be sufficiently extensive for providing a relatively narrow interval between the smallest and the largest size of the coarse fraction. The boundary between the coarse and fine fractions for the coarsely crushed material is suitably selected so that the least quantity and size required for grinding charges is provided with respect to coarse material.

The already described classifying apparatus 13 constitutes an essential component for carrying out the inventive method, and with it there is achieved a very advantageous function in the process technique, which may be summarily described as follows. Apart from the classifying apparatus 13, the screening wall 7 in the primary mill 1 shall have, in accordance with the invention, the screen openings 8 distributed over its entire surface, and they shall have a greatest transverse dimension allowing discharge from the mill 1 having a maximum particle or lump size normally corresponding to the upper, or the greatest lump size for an intermediate fraction in the over-critical size class, and which is intended for use as grinding charge or grinding bodies in a following autogenous secondary mill 23. The material/watery mixture passed out via the openings 8 in the screening wall 7 is subjected in the classifying apparatus to classifying and pulp separation, which classifies the mixed product fed to il into a maximum of four kinds of product, namely: 1) a pimarily ground product comprising the finest ground material fraction, including substantially all the water, this product being taken to the outside classifying 22 means FIG. 1 of the grinding circuit; 2) a fraction above the product just mentioned, and having a greatest particle size less than that critical for grinding; 3) a fraction containing sizes critical for grinding, up to least grinding pebble size for a grinding charge required in a secondary pebble grinding step following the primary grinding step; 4) a grinding pebble fraction which, in accordance with the invention, can be mixed with the critical fraction just mentioned and be specially treated a way described earlier, and which as required can be controllably directed to the secondary mill 23 as a grinding charge.

The invention is not restricted to what has been described above and illustrated on the drawings, and it can be modified in many different ways within the inventive concept disclosed in the following claims.

We claim:

1. In a method of autogenous grinding of mineral material in a rotating drum grinding mill having a screening wall inside of the drum and a discharge end thereof with screening openings distributed over the major part of the screening wall through which a mixed material fraction passes containing all material fractions with a particle size less than or equal to the largest dimensions of the openings, segregating the mixed material fraction in a classifying apparatus into at least a coarse material fraction comprising material to be used as grinding bodies in a subsequent grinding, and a fine fraction constituting material ready-ground in the mill, removing said three fractions from the classifying apparatus, separating said coarse fraction from the medium coarse for allowing selectively diversion of said coarse fraction as grinding bodies for a subsequent grinding step, when required, and mixing said coarse material fraction with said medium coarse fraction when grinding bodies for the subsequent grinding step are not required, the improvement comprising:

providing means for reducing said coarse fraction and medium coarse fraction to a sub-critical size;

passing said mixture of coarse fraction and medium coarse fraction to said reducing means and reducing said mixture to a sub-critical size when said coarse fraction is not diverted to said subsequent grinding step;

returning said reduced size mixture to said mill for renewed grinding;

diverting said coarse fraction to said subsequent grinding step when required; and reducing said medium coarse fraction to said sub-critical size and returning said reduced coarse fraction to said mill for renewed grinding when said coarse fraction is diverted to said subsequent grinding step.

2. The method as claimed in claim 1 wherein:

said diverting step comprises controlling said diversion of said coarse fraction as a requirement from said subsequent grinding step; and said reducing step comprises crushing said medium coarse fraction, and said mixture of said coarse fraction and medium coarse fraction when the coarse fraction is not diverted to said subsequent grinding step.

3. The method as claimed in claim 2 and further comprising:

segregating in the classifying apparatus a coarser medium fraction and a finer medium fraction, the coarser fraction constituting the fraction critical for grinding;

removing said coarser fraction from the classifying apparatus; and returning said finer medium fraction untreated to said drum grinding mill.

4. The method as claimed in claim 3 and further comprising:

providing a return duct extending substantially inwardly towards said drum grinding mill from said classifying apparatus and returning said finer medium fractions through said returning duct.

5. The method as claimed in claim 1 and further comprising:

segregating in the classifying apparatus a coarser medium fraction and a finer medium fraction, the coarser fraction constituting the fraction critical for grinding;

removing said coarser fraction from the classifying apparatus; and returning said finer medium fraction untreated to said drum grinding mill.

6. The method as claimed in claim 5 and further comprising:

providing a return duct extending substantially inwardly towards said drum grinding mill from said classifying apparatus and returning said finer medium fractions through said returning duct.

7. Rotating drum mill apparatus for autogenous wet grinding having a grinding drum with an end wall, a screening wall in said drum spaced from said end wall, a discharge opening between said walls, screening openings in said screening wall for passing therethrough a mixed material fraction containing all material fractions with a particle size less than or equal to the largest size screening openings for passing a coarse material fraction constituting grinding bodies for a subsequent grinding, a classifying apparatus connected to said discharge opening and rotating with said drum for receiving all material passing through said screening openings, and classifying apparatus having coaxially arranged inner and outer screening barrels, openings in said inner screening barrel of a size preventing passage therethrough of said coarse material fraction, a discharge end for said inner screening barrel and diversion means at said discharge end of said inner screening barrel arranged for diverting said coarse material fraction as grinding bodies to a subsequent grinding stage, the improvement comprising:

openings in said outer screening barrel having a size permitting only the passage of a fine material fraction including ready-grounded material;

a discharge end for said outer screening barrel;

conveying means in said outer screening barrel for discharging through said outer screening barrel discharge end material other than said fine material fraction passing through said openings of said inner screening barrel;

means for reducing said material discharged from said discharge ends to a sub-critical size;

means connecting said discharge ends to said reducing means;

said diversion means being adapted for selectively feeding material from both discharge ends to said reducing means and alternatively feeding only material discharged form said outer barrel to said reducing means while diverting said coarse material fraction as grinding bodies to a subsequent grinding stage; and means for returning the sub-critical material from said reducing means to said drum grinding mill for renewed grinding.

8. The apparatus as claimed in claim 7 wherein:

said inner screening barrel comprises two zones, said inner screening barrel openings being in both zones, one of said zones being adjacent said discharge end of said inner screening barrel and having openings greater in size than those in the other zone.

9. The apparatus as claimed in claim 8 and further comprising:

a partition wall disposed between said inner and outer screening barrels for dividing said outer screening barrel into two zones substantially radially outwardly disposed with respect to said two zones in said inner screening barrel, one of said two zones in said outer screening barrel being adjacent said outer screening barrel discharge end;

conveying means in said one zone of said outer screening barrel for discharging through said discharge end of said outer screening barrel material from said one zone of said inner screening barrel;

conveying means in said other zone of said outer screening barrel for returning intermediate fractions from said other zone of said inner screening barrel to said grinding drum mill; and return duct means for returning said intermediate fractions from said inner screen barrel to said grinding drum mill.

10. The apparatus as claimed in claim 8 wherein:

said conveying means comprise a substantially helical screw conveyor.

11. The apparatus as claimed in claim 7 and further comprising:

a partition wall disposed between said inner and outer screening barrels for dividing said outer screening barrel into two zones substantially radially outwardly disposed with respect to said two zones in said inner screening barrel, one of said two zones in said outer screening barrel being adjacent said outer screening barrel discharge end;

conveying means in said one zone of said outer screening barrel for discharging through said discharge end of said outer screening barrel material from said one zone of said inner screening barrel;

conveying means in said other zone of said outer screening barrel for returning intermediate fractions from said other zone of said inner screening barrel to said grinding drum mill; and return duct means for returning said intermediate fractions from said inner screen barrel to said grinding drum mill.

12. The apparatus as claimed in claim 8 wherein:

said conveying means comprise a substantially helical screw conveyor.

13. The apparatus as claimed in claim 7 wherein:

said conveying means comprises a substantially helically screw conveyor.

* * * * *